United States Patent [19]

Avelli

[11] Patent Number: 4,776,363

[45] Date of Patent: Oct. 11, 1988

[54] FIRE HYDRANT HAVING INTERNAL VALVE ACTUATION MEANS

[76] Inventor: Philip A. Avelli, 242 Maple St., Smyrna, Del.

[21] Appl. No.: 936,600

[22] Filed: Dec. 1, 1986

[51] Int. Cl.[4] ..... F16K 31/53

[52] U.S. Cl. ..... 137/296; 137/272; 137/382.5; 251/149.8; 251/248; 251/291

[58] Field of Search ..... 137/272, 296, 382.5; 251/149.8, 248, 291

[56] References Cited

U.S. PATENT DOCUMENTS

| | | | |
|---|---|---|---|
| 1,435,004 | 11/1922 | Henning | 137/382.5 X |
| 1,506,433 | 8/1924 | Knauf | 251/248 |
| 2,006,742 | 7/1935 | Miller | 251/248 X |
| 2,092,926 | 9/1937 | Lithgow | 251/144 X |
| 4,194,523 | 3/1980 | Lubieniecki | 251/291 X |

*Primary Examiner*—Gerald A. Michalsky

*Attorney, Agent, or Firm*—Clement J. Vicari

[57] ABSTRACT

The invention relates to a hydrant comprising a trunk body in which novel valve means for opening the water main is positioned completely within the trunk body and wherein a novel assembly cap is required to activate the valve means.

3 Claims, 4 Drawing Sheets

FIRE HYDRANT HAVING INTERNAL VALVE ACTUATION MEANS

DESCRIPTION OF INVENTION

Technical Field

This invention relates to fire hydrants and specifically to fire hydrants having internally mounted valve actuation means which is actuated by a special cap assembly so that unauthorized use of the hydrant can be prevented.

BACKGROUND OF THE INVENTION

Conventional fire hydrants generally comprise a trunk body, a water inlet through which water from a water main is conducted and a water outlet source which generally comprises two discharge outlets in the form of nozzles having removable caps disposed thereon. The water from the water main is prevented from passing through the water inlet by means of a valve disposed in the trunk extending from the head portion of the trunk body. Thus, if it is desired to discharge water from the fire hydrant, all that is required is that the operator unscrew the caps on the discharge outlets and thereafter turn the exterior operating nut extending from the head portion of the trunk body. Unfortunately, these operations can be performed with conventional tools and equipment such as conventional wrenches and the like, thereby affording an opportunity for unauthorized individuals to cause water to be discharged from the fire hydrant. The unauthorized opening of fire hydrants presents a serious problem to municipalities particularly where there already exists a water shortage. This problem becomes particularly serious in hot weather when fire hydrants are used by unauthorized individuals to cool themselves by the normally cool water which discharges from the fire hydrants. During this time, water sheds and reservoirs are receiving the lowest input of water during the year and this drain on the reservoirs is, therefore, undesirable. In addition to water loss by unauthorized use, a secondary effect of such use is a reduction of the pressure in the mains and in the surrounding hydrants. Since hydrants are primarily used for use in fire fighting, this reduction on pressure can have disastrous results during the demand for fire fighting water especially for high structure buildings. Other side effects include physical harm which may be inflicted upon passing pedestrians and motorists as a result of an unauthorized opened fire hydrant.

Many schemes have been proposed to minimize unauthorized use of hydrants so as to prevent waste of water and maintain pressure in the water main and the surrounding system. One approach for providing a tamper proof hydrant required an annular collar to protect the exposed valve operating nut. Another approach requires the designing of the valve operating nut so that special tools have to be used to operate the valve. Other approaches required protective bands secured over the hydrant caps to prevent their removal without a specially designed tool and the use of special types of locked on hydrant caps which again would require special tools or wrenches to remove them.

In all of the above, externally mounted tamper proof devices are used. These visible external devices can be vandalized or subjected to abuse that could render them inoperative and thereby waste precious time when the hydrants have to be inactivated for official use.

Some municipalities have turned to hydrants with only one outlet nozzle on the hydrant trunk, generally the larger nozzle required by "pumper" engines. This has been done to minimize loss of caps and parts, to lower initial manufacturing cost, and due to the declining requirement and use of the smaller nozzle.

It is an object of the present invention to provide a tamper proof fire hydrant that protects the hydrant from unauthorized use.

Another object of the invention is to provide a fire hydrant with an internally mounted valve operating means so that such means will not be exposed and thereby will be protected against being vandalized or other abusive conditions.

Another object of the invention is to provide a fire hydrant with an internally mounted valve operating means that can only be activated using a special cap assembly designed to seat and be secured on one of the nozzles of the fire hydrant.

The foregoing and additional objects will become apparent from the following description.

DESCRIPTION OF THE INVENTION

The invention relates to a hydrant comprising a trunk body having at least one outlet nozzle; a valve means internally disposed within said trunk body and adapted to move from a first position closing a water main inlet to a second position opening said water main inlet; and a cap assembly means adapted for detachable securement on said outlet nozzle and having an extended valve actuation means for engaging said valve means to effect movement of said valve means between said first position and said second position. The valve means could include engagement means adapted for engageably receiving said valve actuation means.

One specific embodiment of the invention relates to a hydrant comprising a trunk body, at least one outlet nozzle on said trunk body, a cap assembly adapted to be secured to said outlet nozzle; means comprising a frame secured within said trunk body and a rotatable bushing having gear teeth disposed on its periphery and being secured within said frame and prevented from axial movement within said trunk body, a valve means internally disposed within said trunk body, said valve means comprising an elongated, non rotatable axially movable valve shaft, said valve shaft having an upper end threadedly secured within said rotatable bushing and a lower end adapted to close and open a water supply source; said cap assembly comprising a cap having a rotatable valve actuator shaft extending inwardly from said cap and terminating with gear teeth adapted to mate with the gear teeth on the rotatable bushing, said cap assembly having means on the exterior of the cap to rotate said valve actuator shaft and the valve actuator shaft being sufficient in length to permit the gear teeth of the valve actuator shaft to mate with and engage the gear teeth on the rotatable bushing when the cap assembly is secured on a nozzle of the trunk body so that when the valve actuator shaft is rotated its gear teeth will move the gear teeth on the rotatable bushing and cause the valve shaft to axially move either to a first position to close a water supply means or to a second position to open a water supply means.

The cap assembly could be secured on the nozzle by conventional male and female screw threaded means or by any other conventional means such as by the use of straps or other coupling means. The valve actuator shaft on the cap assembly can be spring biased so that once the cap is secured to the nozzle, the spring would force the gear teeth at the end of the shaft to contact and engage the gear teeth on the rotatable bushing.

Another embodiment of the invention relates to a fire hydrant comprising a trunk body, an outlet nozzle on said trunk body, a cap assembly adapted to be secured to said outlet nozzle; a plug means comprising a frame secured within said trunk body and a rotatable bushing having gear teeth disposed on its periphery and being secured within said frame and prevented from axial movement within said trunk body, a valve means internally disposed within said trunk body, said valve means comprising an elongated, non rotatable axially movable valve shaft, said valve shaft having an upper end threadedly secured within said rotatable bushing and a lower end adapted to close and open a water supply source; said cap assembly comprising a cap having a rotatable valve actuator conduit extending inwardly from said cap and terminating with gear teeth adapted to mate with the gear teeth on the rotatable bushing, said cap assembly having means on the exterior of the cap to rotate said valve actuator conduit independently of the cap and the valve actuator conduit being suficient in length to permit the gear teeth of the valve actuator conduit to mate with and engage the gear teeth on the rotatable bushing when the cap assembly is secured on said nozzle of the trunk body so that when the valve actuator conduit is rotated its gear teeth will move the gear teeth on the rotatable bushing and cause the valve shaft to axially move from the said first position or the said second position to either open or close said water supply means.

The cap assembly could be secured on the nozzle by conventional male and female screw threaded means or by any other conventional means. The cap and conduit assembly exterior to the trunk body terminates with means for attaching a fire hose, said means rotatably independent of said conduit.

DRAWINGS

Figure 1:
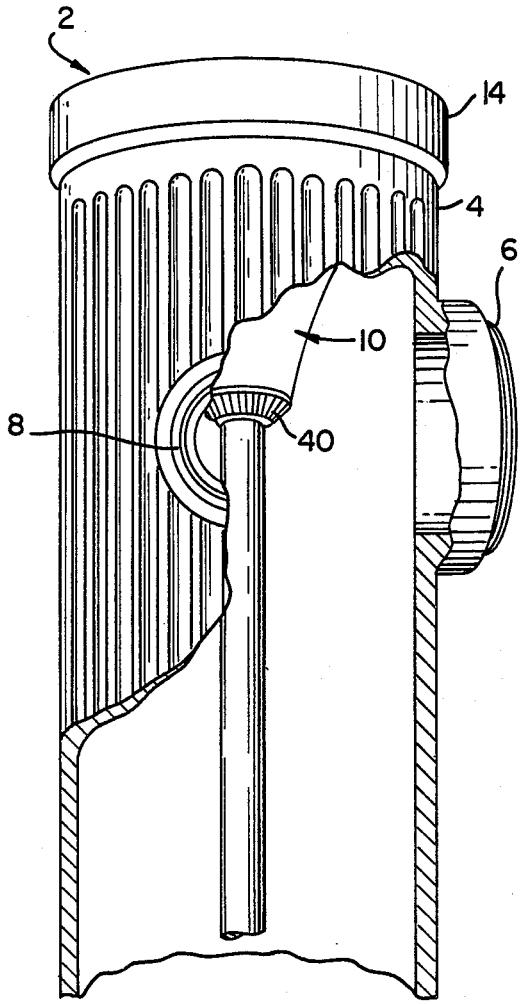
FIG. 1 is a perspective view, partially in cross section, of a hydrant in accordance with the invention which is suitable for hydrants with at least two outlets.
Figure 3:
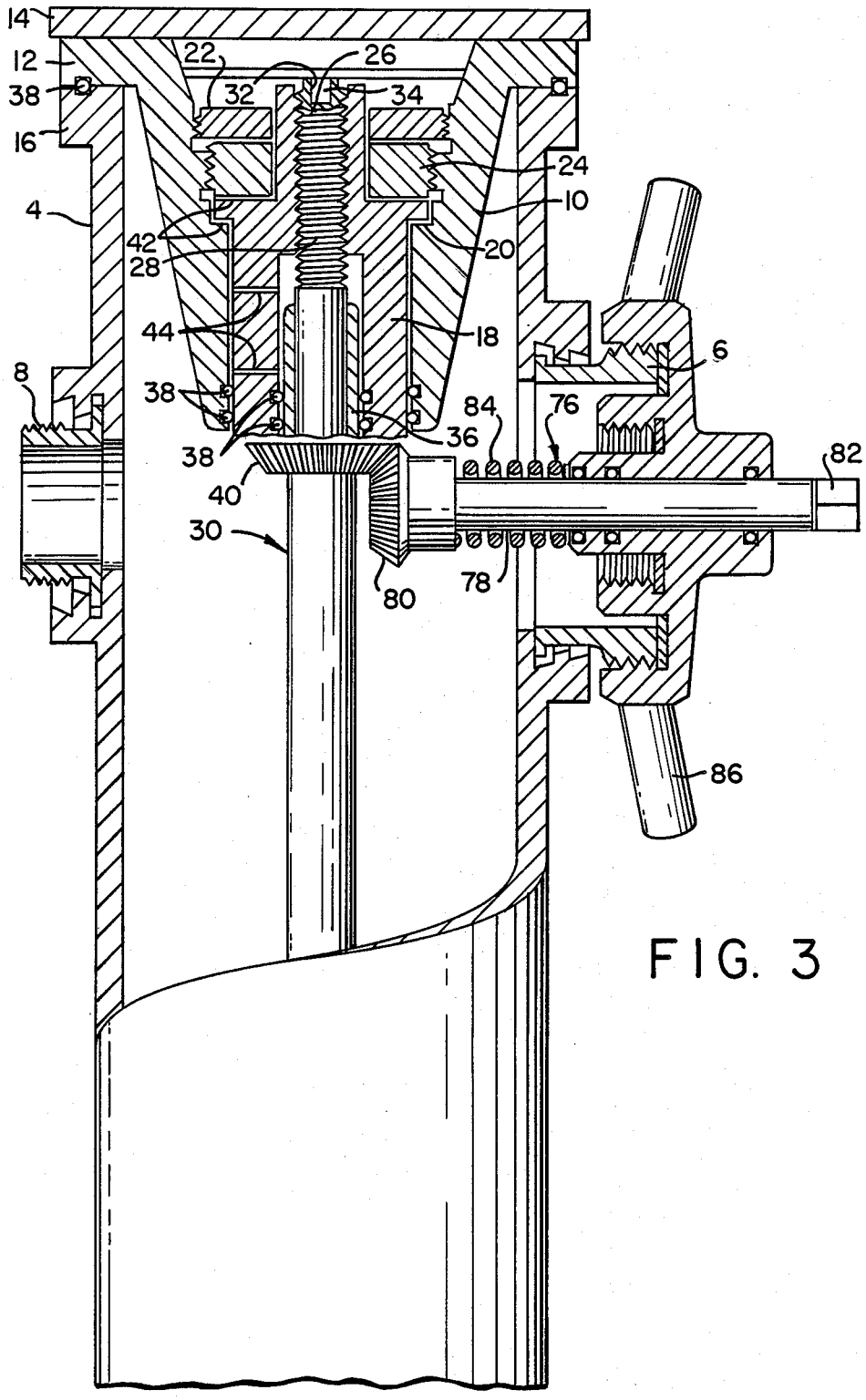
FIG. 3 is a side elevational view, in cross-section, of the hydrant of FIG. 1 having secured on a nozzle the cap assembly of FIG. 2.

Referring to FIGS. 1 and 3, the hydrant 2 comprises a trunk body 4 having male threaded nozzles 6 and 8. Disposed and secured within trunk body 4 at its upper end is a conical tube 10. The base or flange 12 of conical tube 10 is secured between cap 14 and the upper flange 16 of the trunk body 4 by conventional means such as bolting. Disposed within conical tube 10 is a rotatable bushing 18 which seats on flange 20 of conical tube 10 and is secured against axially movement by seal nuts 22 and 24. At the upper internal end of bushing 18 is a female threaded opening 26 into which is threaded the upper end 28 of valve shaft 30. Disposed about and secured to valve shaft 30 is a cylindrical member 36 which is located on valve shaft 30 such that when valve shaft 30 axially moves, cylindrical member 36 will also be in contact with o-rings 38 so as to insure a water tight seal therebetween. Similarly, o-rings 38 are disposed between rotatable bushing 18 and conical tube 10, and between flange 16 and the top surface of trunk body 4 so as to insure a water tight seal between these components. To minimize wear of the moving components, anti-friction washers 42 are used between bearing surfaces of tube 10 and bushing 18. Likewise, lubricant channels 44 are provided to allow lubricant to be placed between rotatable bushing 18 and stationary tube 10 and between rotatable bushing 18 and axially movable shaft 30.

Disposed circumferentially about the lower end of rotatable bushing 18 are gear teeth 40 such that upon movement of the gear teeth 40, bushing 18 will rotate within conical tube 10. Since bushing 18 is secured against axial movement by nuts 22 and 24, and valve shaft 30 is threadedly secured within bushing 18 while being secured against rotational movement by stops (not shown) at the water inlet then rotation of bushing 18 will force valve shaft 30 to move only axially within the hydrant 2. Thus when bushing 18 is rotated, valve shaft 30 will move from a first axial position in which the bottom of the shaft blocks an opening from a water supply means (not shown) to a second axial position in which the bottom of the shaft is moved away from the opening of the water supply means thereby allowing water to flow into the hydrant.

Figure 2:
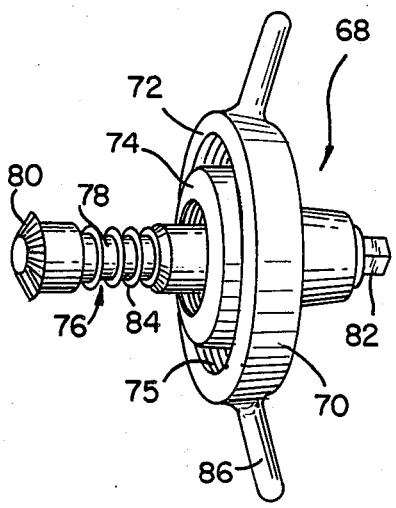
FIG. 2 is a perspective view of a cap assembly of the invention for use on the hydrant shown in FIG. 1.

As shown in FIG. 2, assembly cap 68 comprises a cap portion 70 having an inner female threaded wall 72 and a spaced apart male threaded wall 74 both of which defines an annulus 75. The female threaded member 72 is designed to mate and be secured on the larger male threaded nozzle 6 of FIGS. 1 and 3. The female threaded member 74 is designed to mate and be secured on the small male threaded nozzle 8. Thus the dual threaded screw cap can be secured on a hydrant having a large or small male threaded nozzle.

Secured within the center of cap assembly 68 is a rotatable valve actuation shaft 76 comprising one end 78 extending from the inner surface of the cap assembly 68 and terminating with gear teeth 80 adapted to mate with gear teeth 40 on bushing 18. The opposite end of shaft 76 protrudes from the external surface of cap assembly 68 and terminates with a polygonally shaped nut 82 which can be secured by conventional tool means and then rotated. Spring 84 is disposed about the inner portion of shaft 76 so as to bias the gear teeth 80 into contact with and engagement with gear teeth 40 of bushing 18. Cap assembly 68 has grips 86 radially extending from cap portion 70 so as to facilitate assembly of the cap assembly 76 onto a nozzle of a hydrant.

When hydrant 2 is in an inactive standby mode and connected to a an inner water supply line (not shown), nozzles 6 and 8 are closed using conventional caps (now shown).

In the operational mode of FIGS. 1 through 3, the caps are removed from the nozzles 6 and 8 and cap assembly 68 is screwed onto nozzle 6 or 8 by using grips 86. Once cap assembly 68 is secured on nozzle 6 or 8, shaft 78 protrudes into hydrant 2 whereupon gear teeth 80 engage gear teeth 40 on bushing 18. A hose is then seoured to the other nozzle not holding cap assembly 68.

Rotation of nut 82 will rotate shaft 78 and gear teeth 80 which in turn will rotate gear teeth 40 on bushing 18. As stated above, with valve shaft 30 prevented from rotation and being threadedly secured within bushing 18, and with bushing 18 being rotated and prevented from axial movement, then valve shaft 30 will axially move. Continued rotation of nut 82 will axially move valve shaft 30 from a position where it closes the water main to a position where the water main is open allowing water to flow into the hydrant and out through the nozzle connected to the hose. When the water is no longer needed, the nut 82 is rotated in the opposite direction whereupon the valve shaft 30 moves to close the water main. Cap assembly 68 and the hose are then removed and conventional caps are secured over nozzles 6 and 8.

Figure 4:
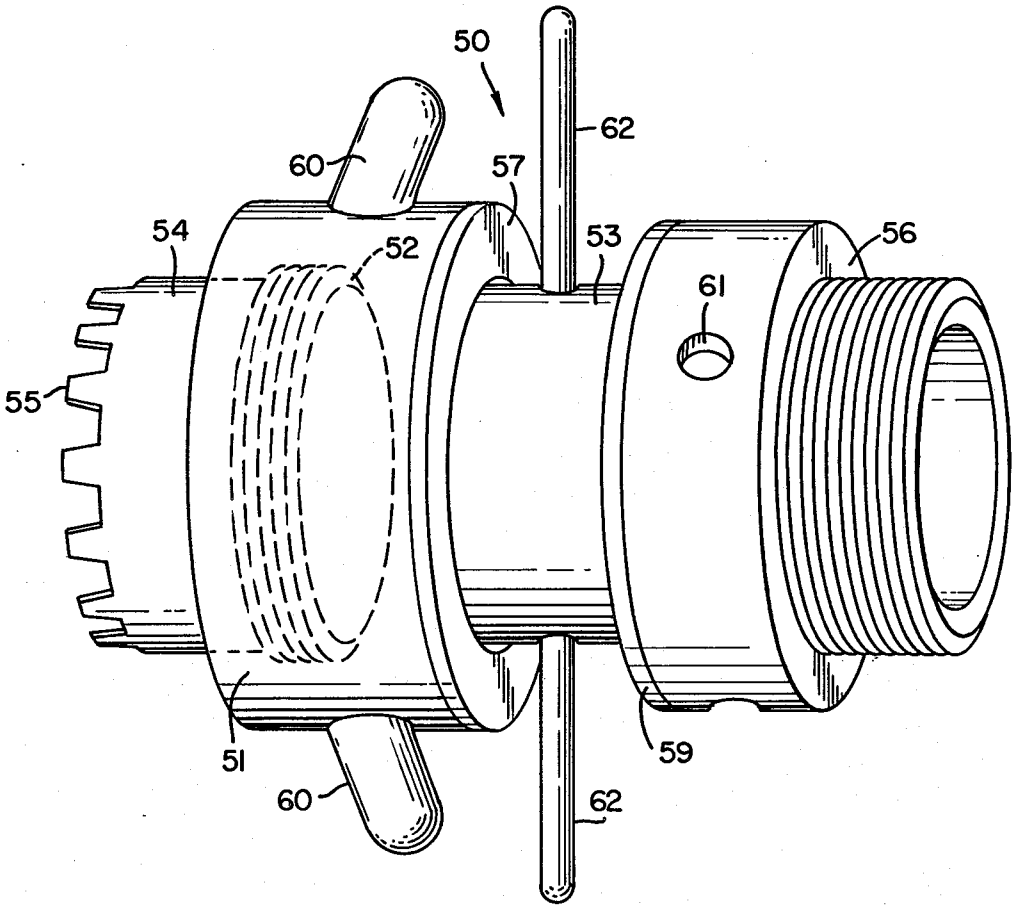
FIG. 4 is a perspective view of a cap and conduit assembly of the invention which is suitable for hydrants with one or more outlets.
Figure 5:
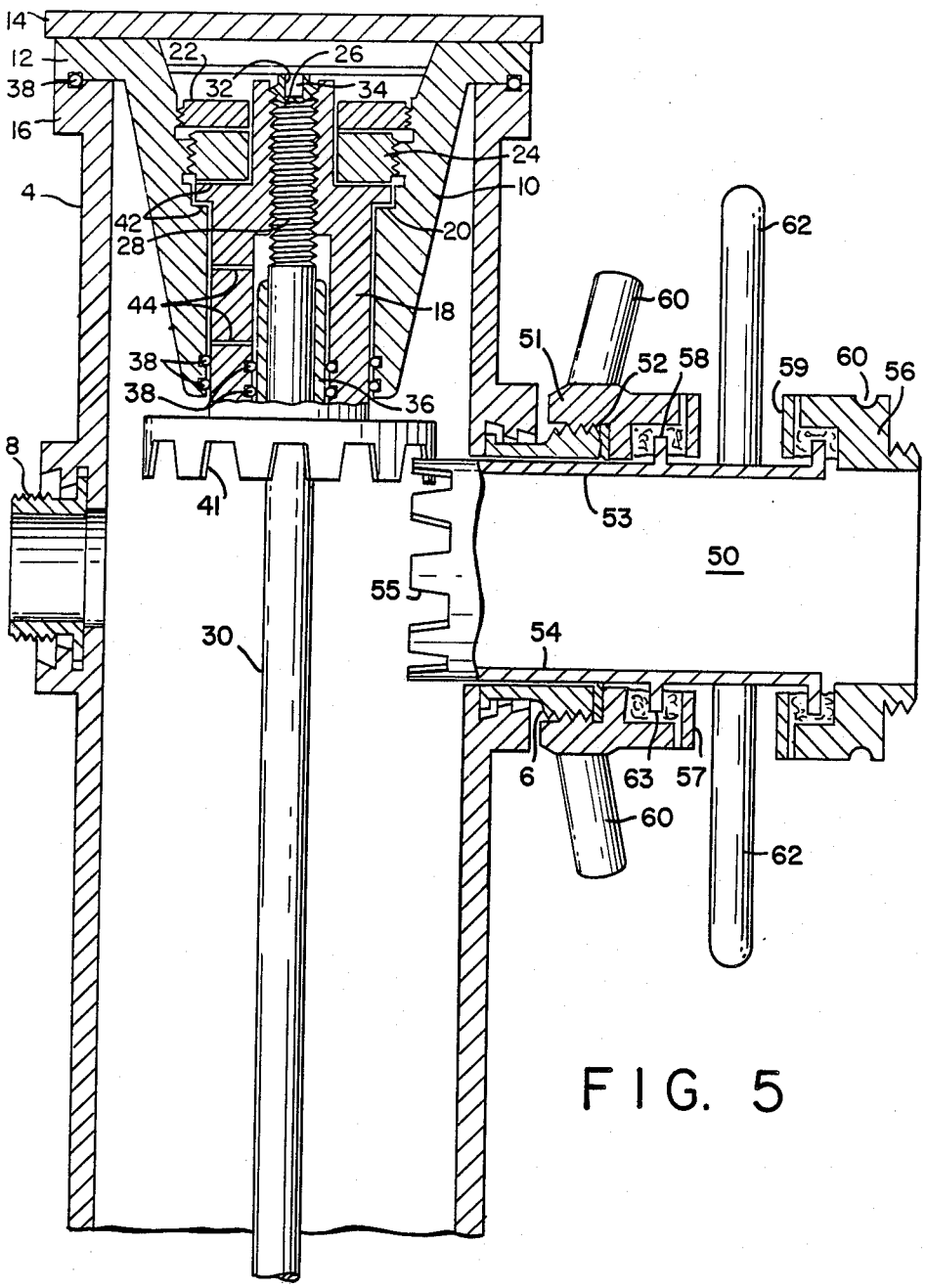
FIG. 5 is a side elevational view in cross-section, of the hydrant of FIG. 1 having secured on a nozzle the cap and conduit assembly of FIG. 4.

FIG. 4 shows another embodiment of the invention comprising a cap and conduit assembly 50 comprising a nozzle cap conduit 51 having an inner female threaded wall 52. The female threaded member 52 is designed to mate with and be secured on a large threaded male nozzle 6 of a fire hydrant as shown in FIGS. 1 and 5. Similar component parts shown in FIGS. 1, 3 and 5 have been identified with the same reference numbers. Axially within the center of cap and conduit assembly 50 is a rotatable valve actuator conduit member 53 having an inner end 54 extending from the hydrant side of assembly 50 and terminating with gear teeth 55 adapted to mate with gear teeth 41 on bushing 18 as shown in FIG. 5 and is described above. The outer end of conduit 53 protrudes from the external surface of cap and conduit assembly 50 and terminates with a hose cap conduit 56. Nozzle cap 51 and valve actuator conduit 53 are both independently rotatable from each other through slip-joint assembly 57. A circumferential protuberance 58 on valve actuator conduit 53 is disposed within slip-joint 57 and seated within annular groove 63 of nozzle cap 51 so as to effectively prevent axial motion of conduit 53 in cap 51. Hose nozzle 56 and valve actuator conduit 53 are also independently rotatable from each other through slip-joint assembly 5. Nozzle cap conduit 51 has grips 60 extending radially to facilitate securing cap and conduit assembly 50 to nozzle 6 of hydrant 2. Hose nozzle 56 has wrench grip indentations 61 to rotate nozzle assembly 56 onto a hose and conduit 53 has radial handles 62 to rotate conduit 53.

When hydrant 2 is in an inactive standby mode and connected to a water supply line (not shown) nozzles 6 and 8 are closed using conventional caps.

In operational mode of FIG. 4 and FIG. 5, the conventional cap is removed from nozzle 6 in FIG. 5, and the cap and conduit assembly 50 is screwed onto nozzle 6 by using grips 60. If hydrant 2 has more than one nozzle, all other nozzles remain conventionally capped unless previously connected to a fire hose. Once assembly 50 is secured to nozzle 6, inner conduit end 54 protrudes into hydrant 2 whereupon gear teeth 55 engage gear teeth 41 on bushing 18. A fire hose is then secured to hose cap conduit 56. Subseguent rotation of valve actuator conduit 53 and gear teeth 55 by means of radial handles 62 will rotate gear teeth 41 on bushing 18. With valve shaft 30 prevented from rotating by stops at the water inlet (not shown) while it is also threadedly secured within bushing 18 then rotation of bushing 18 will cause shaft 30 to move in an axially direction, as discussed above. Continued rotation of handles 62 will move valve shaft 30 from a position which closes the water main to a position to open said water main allowing water to flow into hydrant 2, thence into conduit 53, thence into hose cap conduit 56, and into the connected fire hose. When water is no longer needed, handles 62 are rotated in the opposite direction whereupon the valve shaft 30 moves to close the water main. Cap and conduit assembly 50 is then removed and a conventional cap is secured over nozzle 6. In this embodiment only one nozzle is required on the fire hydrant.

As evident from the above description, the novel hydrant of this invention can only be operated using a novel cap assembly since the valve means are constructed and disposed completely within the hydrant and are therefore protected from vandalism and abuse conditions.

While preferred forms of the invention have been shown and described, it will be apparent that many changes in detail and form can be made without departing from the scope of the appended claims.

What is claimed is:

1. A hydrant comprising a trunk body; at least two outlet nozzles on said trunk body; a cap assembly adapted to be secured to one of the outlet nozzles; a plug means comprising a frame secured within said trunk body and a rotatable bushing having gear teeth disposed on its periphery and being secured within said frame and prevented from axial movement within said trunk body, a valve means internally disposed within said trunk body, said valve means comprising an elongated, non-rotatable axially movable valve shaft, said valve shaft having an upper end threadedly secured within said rotatable bushing and a lower end adapted to close and open a water supply source; said cap assembly comprising a cap having a rotatable valve actuator shaft extending inwardly from said cap and terminating with gear teeth adapted to mate with the gear teeth on the rotatable bushing, said cap assembly having means exterior to the cap to rotate said valve actuator shaft and the valve actuator shaft being sufficient in length to permit the gear teeth of the valve actuator shaft to mate with and engage the gear teeth on the rotatable bushing when the cap assembly is secured on one of the nozzles of the trunk body so that when the valve actuator shaft is rotated its gear teeth will move the gear teeth on the rotatable bushing and cause the valve shaft to axially move either to a first position to close a water supply means or to a second position to open a water supply means.

2. The hydrant of claim 1 wherein said nozzle is a threaded nozzle and said cap assembly has a threaded extension adapted to mate with and be secured with said threaded nozzle.

3. The hydrant of claim 2 wherein said cap assembly comprises a first male threaded extension concentric with a second male threaded extension and one of said male threaded extensions being adapted to mate with and be secured with said threaded nozzle on the hydrant.

* * * * *